US005271335A

United States Patent [19]

Bogenschutz

[11] Patent Number: 5,271,335

[45] Date of Patent: Dec. 21, 1993

[54] ARTICULATION ASSEMBLY FOR RAIL CARS

[75] Inventor: Thomas M. Bogenschutz, Clayton, N.Y.

[73] Assignee: Knorr Brake Holding Corporation, Westminster, Md.

[21] Appl. No.: 950,887

[22] Filed: Sep. 25, 1992

[51] Int. Cl.[5] ..... B61F 3/00

[52] U.S. Cl. ..... 105/4.3; 213/75 R

[58] Field of Search ..... 105/3, 4.1, 4.2, 4.3; 213/75 R, 62 R; 280/511, 512, 513

[56] References Cited

U.S. PATENT DOCUMENTS

| | | | |
|---|---|---|---|
| 4,258,628 | 3/1981 | Altherr | 213/75 R |
| 4,315,465 | 2/1982 | Cordani et al. | 105/4.1 |
| 4,718,351 | 1/1988 | Engle | 105/4.3 |

FOREIGN PATENT DOCUMENTS

| | | | |
|---|---|---|---|
| 0215673 | 3/1987 | European Pat. Off. | 105/3 |

*Primary Examiner*—Mark T. Le

*Attorney, Agent, or Firm*—Barnes & Thornburg

[57] ABSTRACT

An articulation coupling includes a female coupling having a pair of members each forming a portion of an aperture to receive the male coupling and supported for horizontal movement. A structure, for example, a wedge, is provided for biasing the first female member along the longitudinal axis towards the male coupling and elements secure the second member to prevent movement along the longitudinal axis after mating. The first and second female members are of identical structures and each are capable of both receiving a wedge to produce the biasing as well as a pin or other securements. The wedge extends vertically and a spring biases the wedge vertically and maintains it on the car. Preferably the wedge is made up of two segments and provides a pin or other structure for mounting shims between the segments if necessary to accommodate for wear over time.

19 Claims, 5 Drawing Sheets

ARTICULATION ASSEMBLY FOR RAIL CARS

BACKGROUND AND SUMMARY OF THE INVENTION

The present invention relates generally to an improved train, and more specifically to articulation assembly between the cars of integral trains and an intermodal integral train for transporting highway vehicles having their own wheels or other types of loads, without wheels, such as containers.

The design of special cars to be used in a railroad system to carry containers or trucks or truck trailers have generally been modifications of existing railroad stock. These systems have not been designed to operate in the normal railway environment which imposes shock loads on the cars during switching and operating periods, and thus, have not taken advantage of the fact that these lighter loads could be designed for if cars were never uncoupled for switching operations. The economy and operation of the lighter weight trains that could thus be designed, as well as economies in the costs of original material were not taken into account.

As integral train can be made up of a number of subtrains called elements. Each element consists of one or two power cabs (locomotives) and a fixed number of essentially permanently coupled cars. The cars and power cabs are tightly coupled together in order to reduce the normal slack between the cars. The reduction of the slack results in a corresponding reduction in the dynamic forces which the cars are required to withstand during the run in and out of the train slack. The reduction of the dynamic forces allows for the use of lighter cars, which allows for an increase in the cargo weight for a given overall train weight and therefore an increase in train efficiency. Additional improvements in efficiency were to be obtained through the truck design and from other sources.

It is well known that when trains go around a sharp curve, the railroad truck must rotate relative to the body to allow the train to negotiate the curve. Various railroad truck constructions have been provided to allow this to happen. Similarly, articulated couplings have been provided between cars to help steer the railroad cars around the turns. These generally have included adjustable linkages connection the cars to each other and laterally displaced to complementarily elongate and contract. In some trains, a common railroad truck has been provided between adjacent cars which constitutes the articulated coupling. The cars are joined to the truck to pivot at a point along their longitudinal axis and rods are provided at both ends of the truck and connected to each of the cars such that the axle of the truck bisects the angle defined by the adjacent lateral axis of the adjacent cars.

An improved articulated coupling for integral trains is described in U.S. Pat. No. 4,718,351 to Engle. The articulated coupling included a center coupling and a pair of side bearings or couplings coaxial along a lateral axis to facilitate yaw and pitch between two cars while restricting roll. The present invention is an improvement on the Engle articulated coupling.

An object of the present invention is to provide an articulation assembly for integral trains.

Another object of the present invention is to provide a slack-free, wear self-compensating articulation assembly between cars.

These and other objects are attained by providing a female coupling along the longitudinal axis of a body to receive a male coupling along the longitudinal axis of an adjacent car wherein the female coupling includes a pair of members each having an arcuate surface forming a portion of an aperture to receive the male coupling. A structure, for example, a wedge, is provided for biasing the first female member along the longitudinal axis towards the male coupling and elements secure the second female member to prevent movement along the longitudinal axis. By supporting both the first and second female members for movement horizontally along the longitudinal axis and allowing the second female member to be removable, the male member may be more readiably positioned in its mated position adjacent to one of the first female member. The first and second female members are of identical structures and each are capable of both receiving a wedge to produce the biasing as well as a pin or other securing elements. The wedge extends vertically and a spring biases the wedge vertically and maintains it on the car. Preferably the wedge is made up of two segments and provides a pin or other structure for mounting shims between the segments if necessary to accommodate for wear over time. The mounting structure for the shims would be a pin threadably received in one of the wedge segments and received in a bore in the other wedge segment.

A method of coupling a pair of cars including the male coupling and the two member female coupling includes positioning the male coupling adjacent to the first female coupling member and positioning the second female member horizontally adjacent to the male coupling. The second female member is then secured to its car and the male coupling is moved into engagement with the secured second female member. A wedge is then positioned between a body portion of the car and the first female member to bias the first female member towards the male coupling. The wedge is inserted vertically and a spring is mounted to the car to bias the wedge vertically.

Other objects, advantages and novel features of the present invention will become apparent from the following detailed description of the invention when considered in conjunction with the accompanying drawings.

BEST MODE OF CARRYING OUT THE INVENTION

An integral train, as described in U.S. Pat. No. 4,718,351, includes a plurality of cars coupled together to form an element or a subtrain. The element is a continuous deck running for approximately 1,000 feet and constituting approximately 42 cars. Each car has a wheeled end and a wheelless end such that only one axle is required. The deck is made as light as possible yet capable of carrying the desired load. The short platform reduces both relative angular motion of the platform as the train rounds the curve and vertical bending to a much lower value than experienced on conventional trains. The wheelless end of the car overlaps the wheeled end of an adjacent car to form the continuous platform. The mating elements in the overlapping end structures form an articulation assembly which is slack-free and self-compensating for wear.

Figure 1:
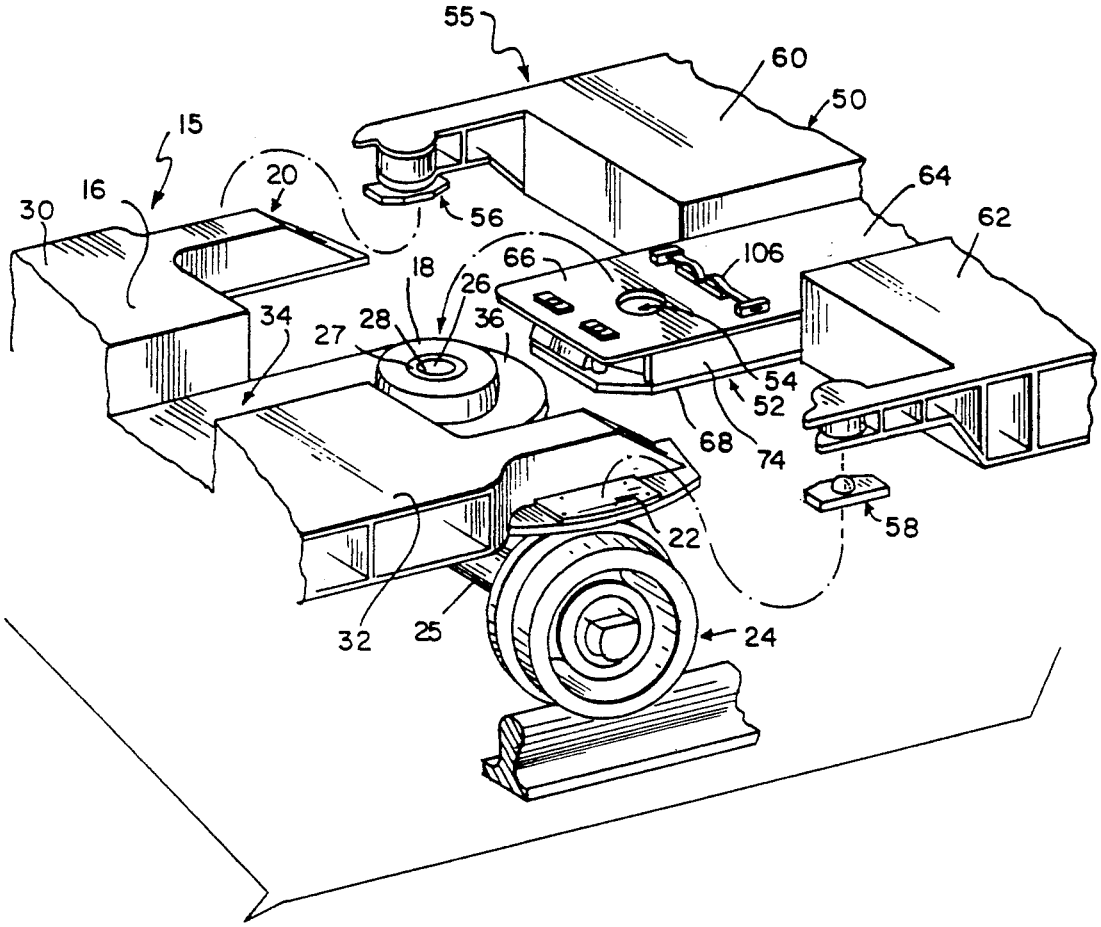
FIG. 1 is a partial perspective view of an articulation assembly of a pair of adjacent cars incorporating the principle of the present invention.

An improved articulated coupling over that of U.S. Pat. No. 4,718,351 is illustrated in FIG. 1 as including a car 15 and an adjacent car 55. The wheeled end of car 15 and the wheelless end of car 55 are illustrated. Each car would have respectively a wheelless end and a wheeled end respectively at the opposite ends of that shown. Car 15 includes a deck 16 having secured thereto a male center coupling 18 along the longitudinal axis of the car and a pair of side supporting surfaces 20 and 22 separated from each other along a lateral axis of the body. The male member 18 is a portion of a sphere and has a vertical axis mounted to an end portion 36 of the deck 16 along the longitudinal axis of the car 15. A set of wheels 24 are on a single axle truck 25 and is connected to the center male coupling 18 by a pin 26 in an aperture 28 of an elastically positioned bearing housing 27 of the male member 18. The body 16 includes two spaced deck portions 30 and 32 to receive the wheels of a road vehicle with a recessed deck portion 34.

The second car 55 includes a body 50 having connected to its end a female center coupling 52 along its longitudinal axis and including an aperture 54 having a vertical axis along the longitudinal axis which is coaxial with the vertical axis of the male coupling 18. Spaced along the lateral axis are a pair of bearings 56 and 58 which cooperate with the bearing surfaces 20 and 22 of car 15 to permit movement of adjacent cars relative to each other in a horizontal plane. The bearings 56 and 58 are mounted by a ball and socket joint to the extended arms of the frame. The deck of car 55 also includes a pair of deck portion 60 and 62 separated by a recess deck portion 64.

Figure 2:
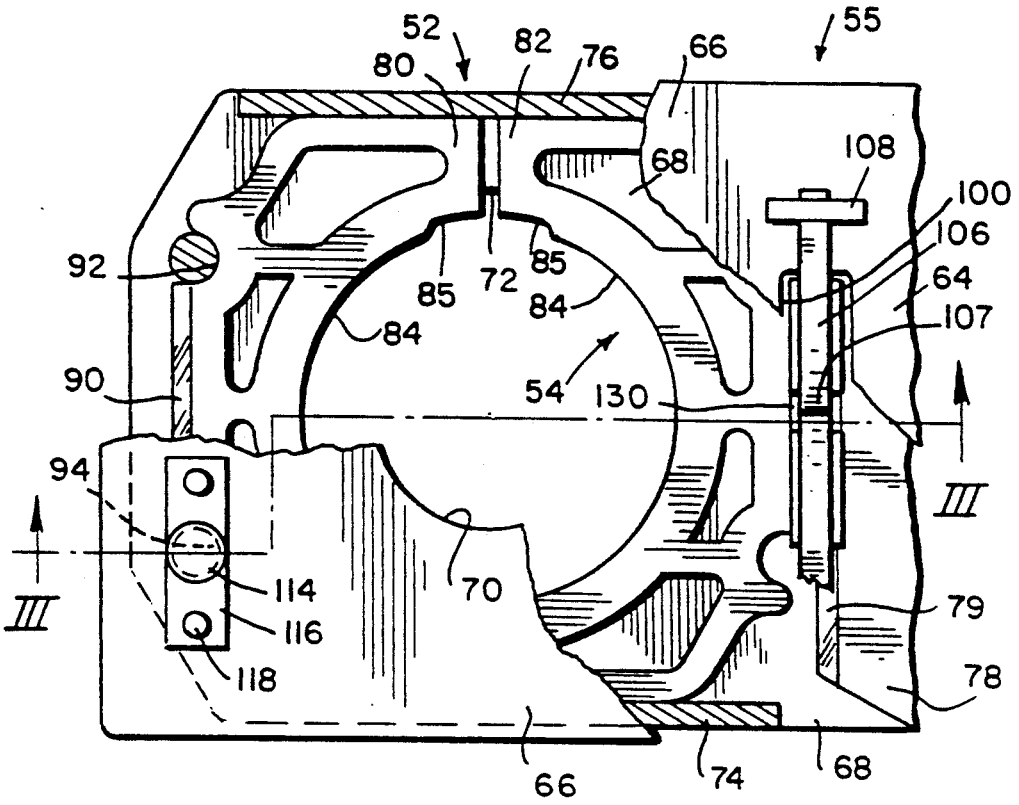
FIG. 2 is a partial section, plan view of a female section of the articulation assembly incorporating the principles of the present invention.
Figure 3:
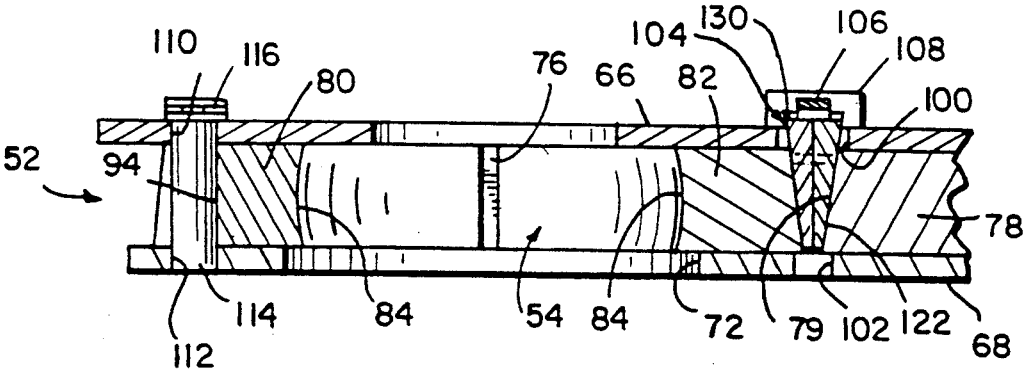
FIG. 3 is a cross-sectional view along the lines III—III of FIG. 2.
Figure 4:
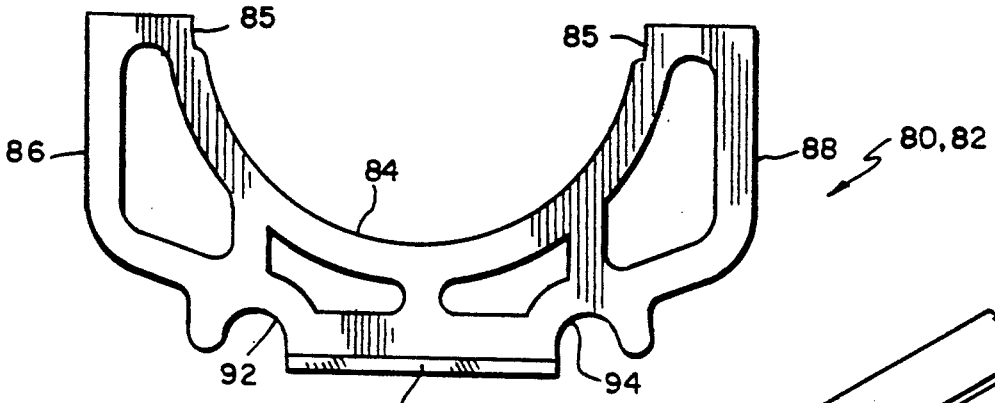
FIG. 4 is a plan view of a female member incorporating the principles of the present invention.

Turning to FIGS. 2, 3 and 4, the female coupling 52 is between a top plate 66 which is an extension of the recess portion 64 of the deck and a lower plate 68. An aperture 70 in the top plate 66 and the aperture 72 in the lower plate 68 are coaxial with the aperture 54 of the female coupling 52. Welded to the top plate 66 and the bottom plate 68 are a pair of lateral guides 74 and 76. The female coupling 52 is a split collar including identical members 80 and 82, each having an arcuate surface 84 which together form the female aperture 54. As illustrated in FIG. 3, the surface 84 is a portion of a spherical surface which is complimentary to the portional spherical section of the male coupling 18.

As shown in detail in FIG. 4, the arcuate members 80 and 82 of the female coupling each includes, adjacent to the open end of the member, a portion 85 recessed so as to be vertical. This allows relief for any irregularities and tolerances. Lateral sides 86 and 88 of the members 80 and 82 engage and are guided along lateral portions 74 and 76 of the extended deck portion. On the exterior portion opposite the arcuate portion 84 is a caming surface 90 at an angle tapering outwardly from the top to the bottom. Adjacent to the tapered portion 90 are a pair of arcs 92 and 94. As will be discussed with respect to FIGS. 2 and 3, the tapered portion 90 receives a wedge and the arc portions 92 and 94 received retaining pins. Although both female members 80 and 82 have both the tapered portion 90 and the arcs 92 and 94, only one of each is used for each member of the pair.

Also, connecting with the top of plate 66 and the bottom plate 68 is a portion 78 having a tapered portion 79 tapering outwardly from the top plate 66 to the bottom plate 68. As we explain below, it will be used with a wedge to adjust the female coupling.

The top plate 66 and the bottom plate 68 each include an elongated slot 100 and 102 respectively to receive a biasing device or wedge 104. The wedge 104 engages the tapered surface 79 of stationery portion 78 of the deck and surface 90 of female number 82 to bias it towards the axis of the aperture 54. The wedge 104 is a vertical wedge and is naturally biased down by gravity. A tension spring 106, including a dimple 107, extends over the top of the wedge 104 to further bias it vertically downward and is secured to the top plate 66 by a pair of restraints or brackets 108. At the other side of the aperture 52, the top plate 66 and bottom plate 68 include two pairs of aligned apertures 110 and 112 respectively which align with the arc sections 92 and 94 of female member 80. A pair of pins 114 extends between the top plate 66 and bottom plate 68 through apertures 110 and 112 and engages the arc sections 92 and 94. Retaining plates or brackets 116 are secured to the top plate 66 by fasteners or bolts 118. The pins 114 removably secure the female member 80 to the car frame while the wedge 104 biases the female member 82 towards the male member 18. The wedge 104 provides the wear compensation feature as well as absorbs buff and draft forces. The pair of female members 80 and 82 provide the slack free connection.

Figure 5:
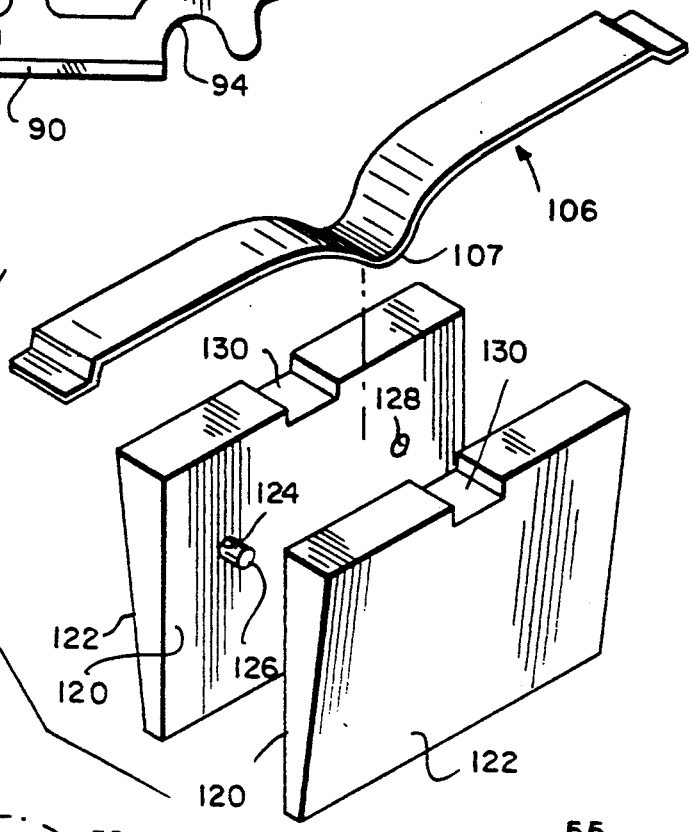
FIG. 5 is an explosive perspective view of a wedge incorporating the principles of the present invention.
Figure 6:
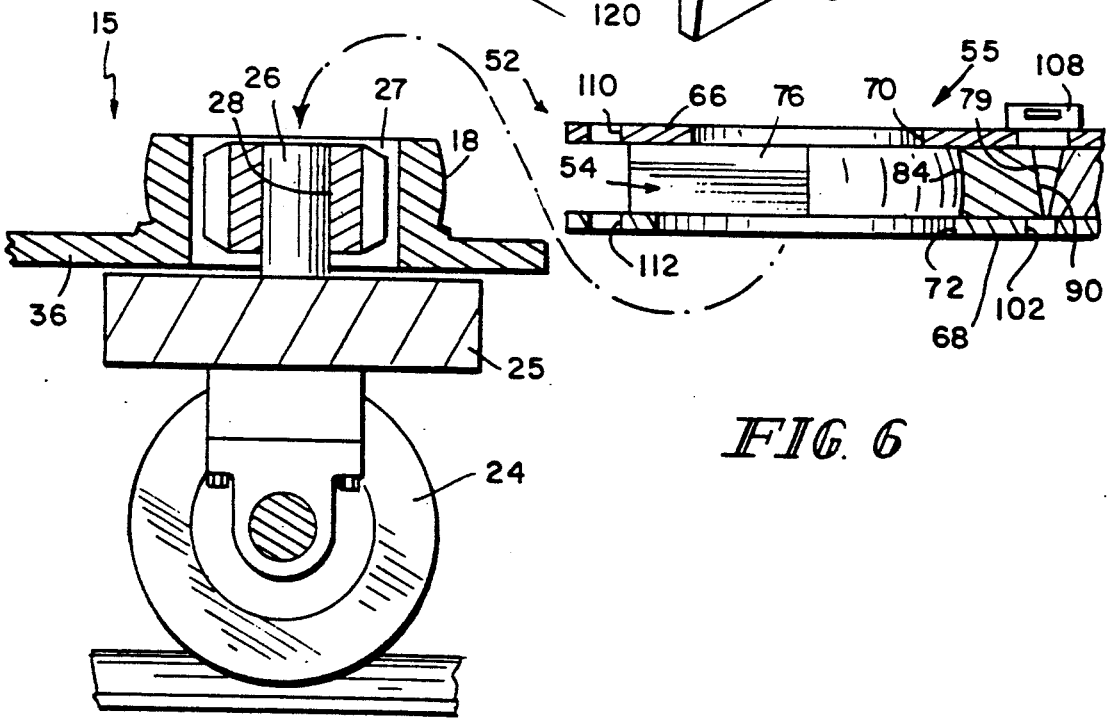
FIGS. 6 through 10 are partial cross-sectional views showing the sequence of coupling a pair of cars incorporating the principle instruction of the present invention.

The wedge 104 is formed of a pair of identical members as illustrated in FIG. 5 each having a flat face 120 and a tapered face 122. The flat face 120 includes a bore 124 threadably receiving a pin 126 and a nonthreaded bore 128. The bore 128 on one member will receive the extended pin 126 from its complimentary members. The two pairs are mated at the flat surface 120. If excessive wear is experienced and it will not be compensated by the taper of the tapering surface 122, shims may be provided between the halves of the wedge 104. Shims or other material may be provided between the flat surfaces 120. They may be retained therein by having appropriate bores to receive the pin 126. A lateral recess 130 in the center of the wedge segments 104 receive the dimple 107 extending from the lower surface of spring 106. This prevents the spring from moving laterally between the brackets 108.

The unique features of the present articulated assembly will be described with respect to FIGS. 6 through 10. The female coupling 52 on car 55 has the female member 80 removed from between the plate 66 and 68 or at least moved substantially out of the aperture 72 of the lower plate 68. Also, the wedge 104 has been removed to allow the female member 84 to be recessed from the bottom of aperture 72 in the bottom plate 68.

The female coupling 52 of car 55 and the male coupling 18 of car 15 are moved towards each other with the female coupling 52 being raised above the male coupling 18. The male coupling 18 is then received through aperture 72 in the bottom plate 68 with the top edge coming to rest on the bottom surface of top plate 66. The top surface of deck 36 of the male coupling is spaced from the bottom surface of bottom plate 68 of the female coupling 52. The lateral bearing surfaces 56 and 58 ride on bearing plates 20 and 24 illustrated in FIG. 1. The resulting alignment is illustrated in FIG. 7 where the vertical axis of the male member 18 is coaxial with the axis of apertures 54, 70 and 72.

Figure 7:
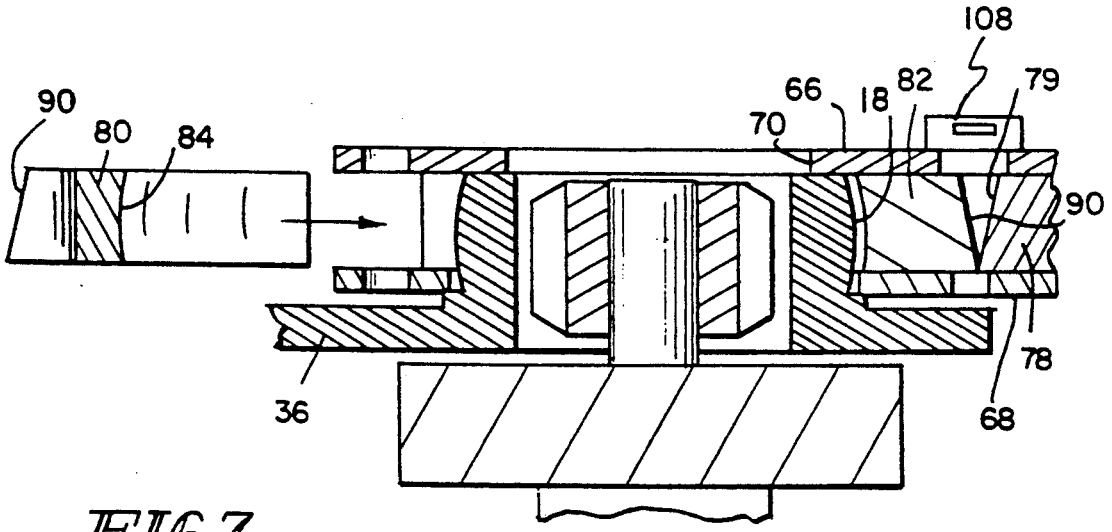
Figure 8:
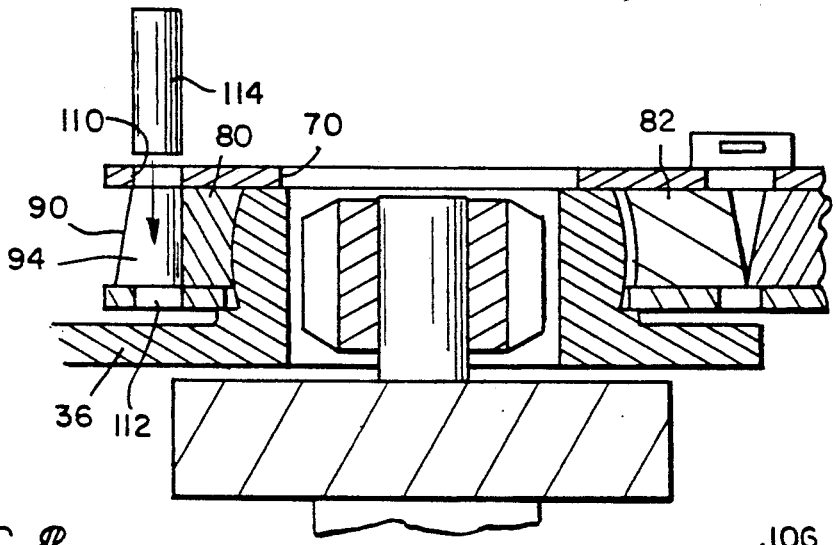

Next, the female member 80 is inserted or moved horizontally between plates 66 and 68 as illustrated in FIG. 7 to be positioned adjacent to the male coupling 18 as illustrated in FIG. 8. Once the arc portions 92 and 94 of the female member 80 are aligned with the apertures 110 and 112 in plates 66 and 68 respectively, the retaining pins 114 are extended therethrough as illustrated in FIG. 8. The retaining brackets 116 for pins 114 may be installed at this point or later in the process.

Figure 9:
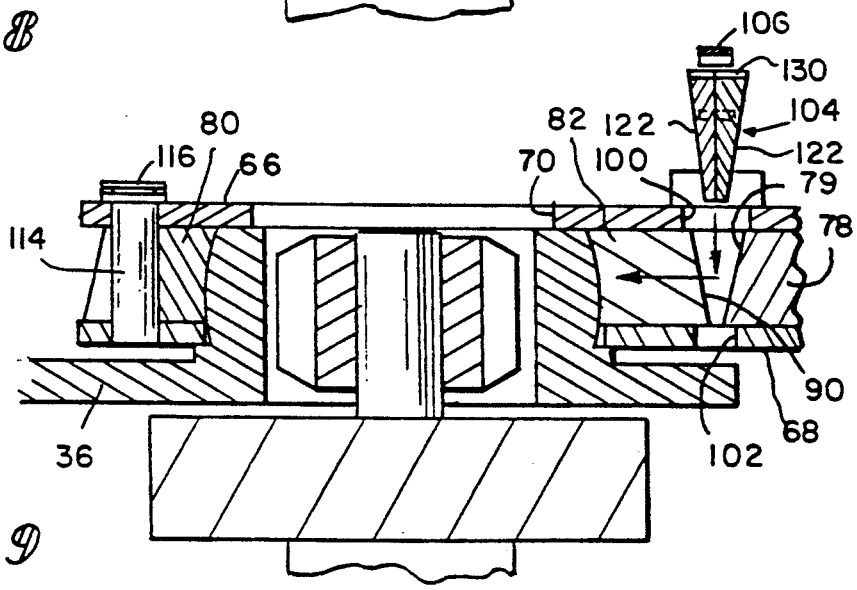
Figure 10:
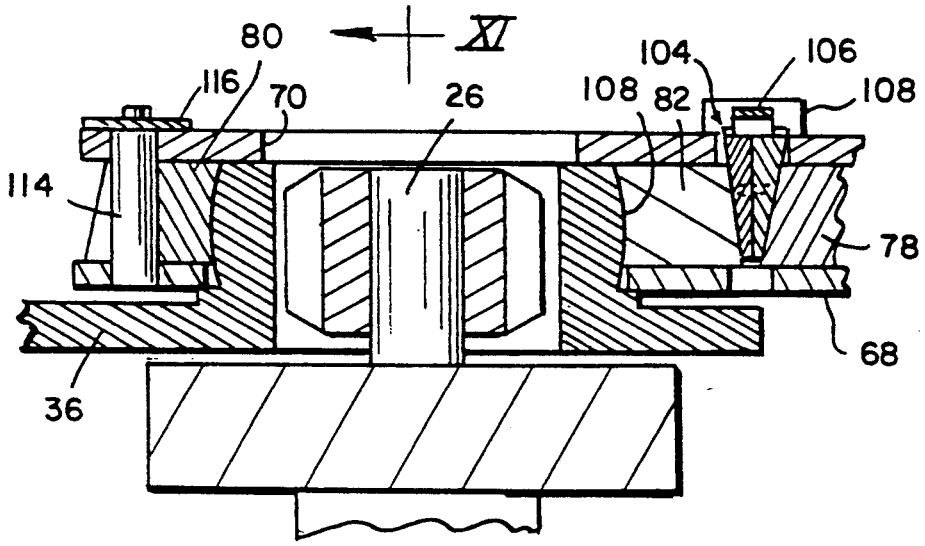
Figure 11:
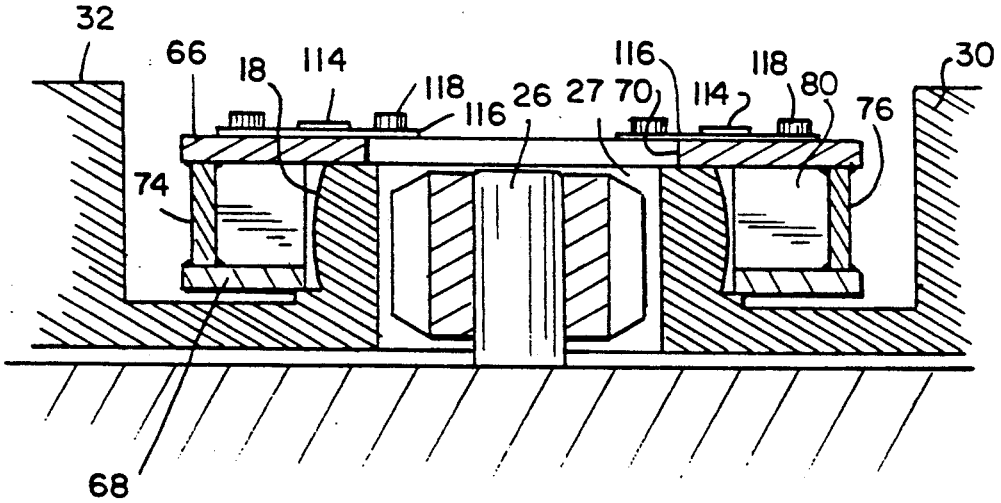
FIG. 11 is an end view along the lines XI—XI of FIG. 10.

Once the female member 80 has been secured, the two cars 15 and 55 are moved away from each other bringing the male coupling 18 into contact with the arcuate portion 84 of the female member 80. The wedge 104 is then inserted through the elongated opening 100 in the top plate 66 engaging the tapered surfaces 79 and 90 of the stationary structure 78 and the female member 82 respectfully. This biases the female member 90 towards the male coupling 18 as illustrated in FIG. 9. Once the female member 90 engages the male coupling 18, the tension spring 106 has its dimple 107 aligned with recess 130 of the wedge and is mounted into brackets 108. The two cars are no longer being held in tension moving the opposite directions. The final mating structure is illustrated in FIG. 10 with an end view in FIG. 11.

Although the articulation assembly has been discussed in connection with intermodal integral trains, they are equally applicable to other integral trains and even non-integral trains. Similarly, the use of male and female, with respect to the couplings and bearings, are to distinguish the mating members with respect to each other and have no other significance.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An articulation assembly for connecting first and second rail cars each having a body with first and second ends comprising:

male coupling means extending along a vertical axis at said first end and on the longitudinal axis of said body of said first rail car and female coupling means at said second end of said body of said second rail car and having an aperture whose axis is coaxial with said vertical axis when mated with said male coupling means of said first rail car;

said female coupling means including a first member having an arcuate surface forming a portion of said aperture and facing away from said body of said second rail car and a second member removably mounted to said body of said second rail car, having an arcuate surface forming a portion of said aperture and facing toward said body of said second rail car, said first and second members being identical structures.

2. An articulation assembly according to claim 1, wherein said female coupling means includes track means for supporting said first and second members for horizontal movement.

3. An articulation assembly according to claim 1, wherein said male coupling means includes a surface which is a portion of a sphere and said arcuate surfaces are complementary portions of a sphere.

4. An articulation assembly according to claim 3, wherein portions of said arcuate surfaces of said first and second members at their adjacent ends are vertical.

5. An articulation assembly according to claim 1, including second and third coupling means, each including a pair of bearing surfaces, one of each associated with each end, and being separated from each other along a lateral axis of said body, for facilitating movement of said first and second ends relative to each other in a horizontal plane.

6. An articulation assembly for connecting first and second rail cars each having a body with first and second ends comprising:

male coupling means extending along a vertical axis at said first end and on the longitudinal axis of said body of said first rail car and female coupling means at said second end of said body of said second rail car and having an aperture whose axis is coaxial with said vertical axis when mated with said male coupling means of said first rail car;

said female coupling means including first and second members each having an arcuate surface forming a portion of said aperture and a track means for supporting said first and second members for horizontal movement relative to each other;

means for biasing said first member horizontally toward said male coupling means; and means for removably securing said second member to said female coupling means.

7. An articulation assembly according to claim 6, wherein said first and second members are identical structures and operable with both said biasing means and said securing means.

8. An articulation assembly according to claim 6, wherein said biasing means includes a wedge extending vertically and a spring biasing said wedge vertically.

9. An articulation assembly according to claim 8, wherein said spring includes a dimple on its lower surface and said wedge includes a recess receiving said dimple and limiting movement of said spring transverse to said recess.

10. An articulation assembly according to claim 6, wherein said securing means includes at least one pin extending vertically between two opposed surfaces of said female coupling means and engaging said second member.

11. An articulation assembly according to claim 10, wherein said first and second members each includes, for each pin, an arc on its periphery for engaging a portion of the periphery of a pin.

12. An articulation assembly for connecting first and second rail cars each having a body with first and second ends comprising:

male coupling means extending along a vertical axis at said first end and on the longitudinal axis of said body of said first rail car and female coupling means at said second end of said body of said second rail car and having an aperture whose axis is coaxial with said vertical axis when mated with said male coupling means of said first rail car;

said female coupling means including a first member having an arcuate surface forming a portion of said aperture and a track means for supporting said first member for horizontal movement; and means for biasing said first member horizontally toward said male coupling means and including a wedge having two separable segments and means for mounting shims between said segments.

13. An articulation assembly according to claim 12, wherein said wedge segments each include at least one bore and said shim mounting means includes a pin extending between aligned bores in said wedge segments.

14. An articulation assembly according to claim 13, wherein said pin is threaded into one of said bores.

15. An articulation assembly according to claim 12, wherein said wedge extends vertically and including a spring biasing said wedge vertically.

16. An articulation assembly according to claim 15, wherein said spring includes a dimple on its lower surface and said wedge includes a recess receiving said dimple and limiting movement of said spring transverse to said recess.

17. A method for coupling a pair of rail cars having a male coupling extending along a vertical axis of a first car and female coupling of a second car having an aperture whose axis is coaxial with said vertical axis when mated with said male coupling; said female coupling including first and second members each having an arcuate surface forming a portion of said aperture and said first and second members being moveable along a longitudinal axis of said second car; the method comprising:

positioning said male coupling adjacent said first member;

positioning said second member horizontally on said second car adjacent said male coupling;

securing said second member to said second car;

moving said male coupling into engagement with said secured second member; and positioning a wedge between a body portion of said second car and said first member to bias the first member towards said male coupling.

18. A method according to claim 17, wherein said wedge is inserted vertically; and including mounting a spring to said second car to bias said wedge vertically.

19. An articulation assembly for connecting first and second rail cars each having a body with first and second ends comprising:

male coupling means extending along a vertical axis at said first end and on the longitudinal axis of said body of said first rail car and female coupling means at said second end of said body of said second rail car and having an aperture whose axis is coaxial with said vertical axis when mated with said male coupling means of said first rail car;

said female coupling means including first and second members each having an arcuate surface forming a portion of said aperture and a track means for supporting said first and second members for horizontal movement relative to each other; and means for removably securing said second member to said female coupling means.

* * * * *